United States Patent [19]

Kobayashi et al.

[11] 4,408,417

[45] Oct. 11, 1983

[54] FULLY AUTOMATIC BARREL FINISHING MACHINE

[75] Inventors: Hisamine Kobayashi; Mutsumi Miyashiro, both of Nagoya, Japan

[73] Assignee: Shikishima Tipton Mfg. Co., Ltd., Nagoya, Japan

[21] Appl. No.: 313,996

[22] Filed: Oct. 21, 1981

[30] Foreign Application Priority Data

| | | | |
|---|---|---|---|
| Oct. 31, 1980 | [JP] | Japan | 55-154498 |
| May 6, 1981 | [JP] | Japan | 56-65536[U] |
| Sep. 17, 1981 | [JP] | Japan | 56-146620 |

[51] Int. Cl.[3] ..... B24B 19/00

[52] U.S. Cl. ..... 51/163.2

[58] Field of Search ..... 51/163.2, 163.1, 164 R, 51/7, 313

[56] References Cited

U.S. PATENT DOCUMENTS

| | | | |
|---|---|---|---|
| 3,435,565 | 4/1969 | Blundell . | |
| 3,800,478 | 4/1974 | Rampe | 51/163.1 |
| 3,990,188 | 11/1976 | Balz | 51/163.2 |
| 4,177,608 | 12/1979 | Balz | 51/163.2 |
| 4,363,194 | 12/1982 | Balz | 51/163.1 |

*Primary Examiner*—Harold D. Whitehead

*Attorney, Agent, or Firm*—Wenderoth, Lind & Ponack

[57] ABSTRACT

A barrel-type finishing machine provides the fully automatic functions which permit the finishing process such as surface finishing, radiusing, gloss polishing, etc., and other associated operations to be performed for each succeeding cycle of the sequence of those operations. The machine includes a dual barrel structure consisting of an upper stationary container of a cylindrical shape and a lower rotary shallow container of a tray shape which are partly or wholly movable up and down relative to each other; and an annular mass receptacle trough surrounding close to the dual barrel structure and including means for causing the mass receptacle trough to be moved up and down, means for separating the mass into workpieces and abrasive media, means for returning the abrasive media for reuse, and vibration generating means for placing the mass collector conduit under vibration, means may be included for controlling the toroidal flow of the mass inside the dual-barrel structure by producing a centrifugal force. For the wet type finishing application. The machine further include means for preventing leaks of compound solution from the dual-barrel structure from entering the rotary shaft bearing box. The machine has a wide range of applications including the surface finishing, radiusing, polishing, deburring, milling, mixing, agitating and the like.

13 Claims, 9 Drawing Figures

FULLY AUTOMATIC BARREL FINISHING MACHINE

BACKGROUND OF THE INVENTION

1. Field of the Invention

The present invention relates generally to a workpiece surface finishing machine, and more particularly to an improved finishing machine having a dual barrel structure including an upper stationary container and a lower rotary container either of which is movable up and down relative to the other. The finishing machine provides fully automatic functions which permit the finishing operations such as surface finishing, deburring and the like, and other associated operations including the charging and discharging a mass (which is a mixture of workpieces and abrasive media, which is hereinafter referred to as such) to and from the dual barrel structure, the separation of the mass into workpieces and abrasive media of the end of each cycle of the finishing operation, the return of the abrasive media for reuse, and the transfer of the finished workpieces for any subsequent process.

2. Description of the Prior Art

Usually, the conventional surface finishing machine of the type disclosed herein has a dual barrel structure used for subjecting the workpieces to the finishing process and including an upper stationary container and a lower rotary container, which contain a lot of workpieces to be finish-processed and an abrasive media. For the operation of the prior art surface finishing machine, the lower rotary container is driven for rotation, causing the mass to have a toroidal motion within the dual barrel structure. One form of such machine, as disclosed in the Japanese patent application No. 50-25678 now published after examination and the Japanese utility model registration application No. 51-62189 now published as unexamined, has a dual barrel structure the upper and lower containers of which for operation are maintained close to each other and after the operation are moved away from each other to allow the mass to be discharged, and also includes a vibrating sieve or screening device located below the lower rotary container. Another form of the machine, as disclosed in the Japanese utility model registration application No. 54-15390 now published as unexamined, includes a dual barrel structure which is capable of tilting as a whole, and a vibrating sieving device below the lower rotary container. In the latter prior art machine, the upper barrel is open at the top, and when it is tilting, the mass in the barrel is allowed to be discharged from the open top down onto the screening device. In a third form of the machine, as disclosed in the Japanese utility model registration application No. 53-26718 now published as unexamined, the lower rotary container has a central hole at the bottom through which the mass is to be discharged onto the vibrating sieve below. In any of the forms mentioned above, the size of the mass separating or sieving structure must be large enough to receive all the mass properly from the container since otherwise some workpieces and/or abrasive media would possibly escape from the sieving device. When such large size mass separating structure is used with the surface finishing machine, however, the machine main frame must be built to a size that is sufficient to accommodate the mass separating structure. In addition to this disadvantage, there is another disadvantage that when the mass is discharged onto the sieving structure after the finishing operation, it is actually observed that an extremely large amount of the mass is discharged onto the sieving structure at a time as the discharge is practically uncontrolled. This uncontrolled discharge prevents the smooth mass separation to be performed by the sieving structure that is being vibrated. It therefore requires a longer period of time to complete the separating operation for a particular lot of the mass, with the accompanying adverse effect upon the workpieces to be separated from the abrasive media. That is, since the workpieces are travelling in closely spaced relationships on the sieving path and are thus more likely to impinge against each other, they have more chances of being damaged, such as impingement marks on the surface. The abrasive media collected by the separating operation is usually returned manually to the barrel structure if it is again to be used. For the automatic return of the abrasive media, it is necessary to provide an independent return apparatus. In order to implement the fully automatic operations including the automatic return of the abrasive media, the machine must be built to an increased size, which results in an increased cost of manufacture.

For the wet-type finishing operation under wet condition which is performed by using a liquid abrasive media together with water, liquid compound solution and the like, there is also known means for preventing leaks that occur in the sliding interface between the upper stationary container and the lower rotary container from entering into the bearing box supporting therein the rotary shaft for the rotary container (as disclosed in the earlier mentioned patent application No. 50-25678). This prior art machine solves the problem of the leaks by providing a dual structure rotary container which consists of an upper rotary portion containing a mass and a lower non-rotatable portion enclosing the bottom of the upper rotary portion and adapted to provide a passage for the leaks. In accordance with this prior art machine, however, the rotary shaft which rotatably supports the rotary container must be mounted to extend through the rotary container up to the upper stationary container. This rotary shaft portion exposed in the stationary container prevents the smooth toroidal flow of the mass in the dual barrel container. Another problem is that leaks of a compound solution mixed with worn out abrasive particles remaining on the passage inside the lower non-rotatable portion of the rotary container are led to enter the bearing box along the length of the rotary shaft, which also causes an improper function of the machine. It is also observed that particles of the abrasive media leaks are easily deposited to form a solid layer. This prevents the smooth rotation of the rotary shaft, thus causing an increase in the electric current through the motor. This current increase damages the motor.

SUMMARY OF THE INVENTION

In view of the disadvantages and problems of the prior art, and in order to obviate from those, one object of the present invention is to provide the fully automatic surface finishing machine which comprises a dual barrel structure consisting of an upper stationary container and a lower rotary container, and an annular mass receptacle trough structure for the mass separation surrounding close to the dual barrel structure and capable of movement up and down, whereby it permits both the automatic mass separating operation and the automatic return of the abrasive media as separated to the barrel structure to be performed concurrently.

To accomplish the above object, in accordance with the surface finishing machine, the upper stationary container of the dual barrel structure is partly or wholly capable of movement up and down, and the annular mass receptacle trough structure also includes means for separating the mass into workpieces and abrasive media and means for placing the structure under vibration. This construction provides the advantage of reducing the floor space on which the whole machine is to be installed, thereby permitting an economical use of the available effective space. This also eliminates the need for a separate return device for the separated abrasive media, which has been used with the prior art.

Another object of the present invention is to provide an improved and economical surface finishing machine which provides totally automatic operations which are performed sequentially, such as the charging of workpieces and abrasive media, the workpieces finishing process, the discharging of the finish-processed workpieces together with the abrasive media used for that process, the separation of the mass into the finished workpieces and the abrasive media, the returning of the abrasive media for reuse, and the transfering of the finished workpieces for any required subsequent process. Those sequential operations are also automatically repeated for each succeeding cycle of the surface finishing process. In order to implement the above object, an annular guide conduit is provided below the annular mass receptacle trough so that it can receive and transport the abrasive media falling down through the mass receptacle trough. The annular guide conduit includes a container which contains a next lot of workpieces to be processed and/or new abrasive media, and a fluid-operated stopper for controlling the supply of the workpieces and/or abrasive media into the barrel structure.

Still another object of the present invention is to provide means for gradually discharging a mass from the barrel structure onto the annular mass receptacle trough. This means prevents the mass from being discharged onto the mass separating path at a time. The combination of the annular mass receptacle trough and annular guide conduit cooperates with the above-mentioned means so that the mass can be effectively separated and the workpieces remaining on the separating path can be made to travel toward the outlet port connected as an extension of the separating path. This eliminates any possibility of causing the workpieces to impinge against each other while travelling on the separating path.

A further object of the present invention is to provide means of charging the separated abrasive media together with a new lot of workpieces into the finishing barrel structure for a next succeeding cycle of the finishing operation. To this end, a charging port is provided at the end of the annular guide conduit, through which the abrasive media and the new lot of workpieces to be added to the media from the workpiece container are gradually to be charged into the barrel structure. As the mass is travelling on the guide path toward the charging port in such a manner that the workpieces are enclosed within the abrasive media, the occurrence of damages such as impingement of the workpiece surfaces can be effectively eliminated when the mass is being charged into the barrel structure.

A still further object of the present invention is to provide means for preventing leaks of the compound solution mixed with worn out abrasive particles that occur from the barrel structure from entering the bearing box supporting the rotary shaft for the lower rotary container. In order to attain the above object, for the wet-type surface finishing process under wet condition in which abrasive media together with water compound and the like is also used, an annular leak collector conduit is provided below the lower rotary container, which is designed to receive leaks that may occur in the sliding interface between the upper stationary container and lower rotary container. In addition, a cylindrical member is also provided to extend downwardly from the underside bottom of the rotary container. The cylindrical member cooperates with the annular leak collector conduit such that the cylindrical member rotating with the rotary container dispels the leaks outwardly into the annular leak collector conduit. The combined action of the above two parts prevents the leaks from entering into the bearing box along the longitudinal axis of the rotary shaft. This effectively protects the bearing against the leaks, thus maintaining it in the proper running condition. This construction also eliminates the need of providing a dual structure for the lower rotary container which consists of an upper rotary portion and a lower stationary portion which receives the leaks. Particles of the abrasive media will not be deposited to form a solid layer on the lower receptacle portion, and the problem of preventing the smooth rotation of the rotary shaft can be avoided. As the rotary shaft is no longer required to be exposed in the upper stationary container, the amount of a mass to be contained at one time can be increased. Also, the absence of the exposed shaft portion helps the mass have a smooth toroidal flow.

BRIEF DESCRIPTION OF THE DRAWING

Other objects, features and advantages of the present invention will become apparent from the following description to be given by reference to the several preferred embodiments shown in the accompanying drawing, in which.

DETAILED DESCRIPTION OF PREFERRED EMBODIMENTS

The term "surface finishing process or operation" referred to hereinafter should be understood to include, besides the surface finishing operation, other operations or processes such as deburring, radiusing, polishing, milling, mixing, agitating and other similar operations.

Figure 1:
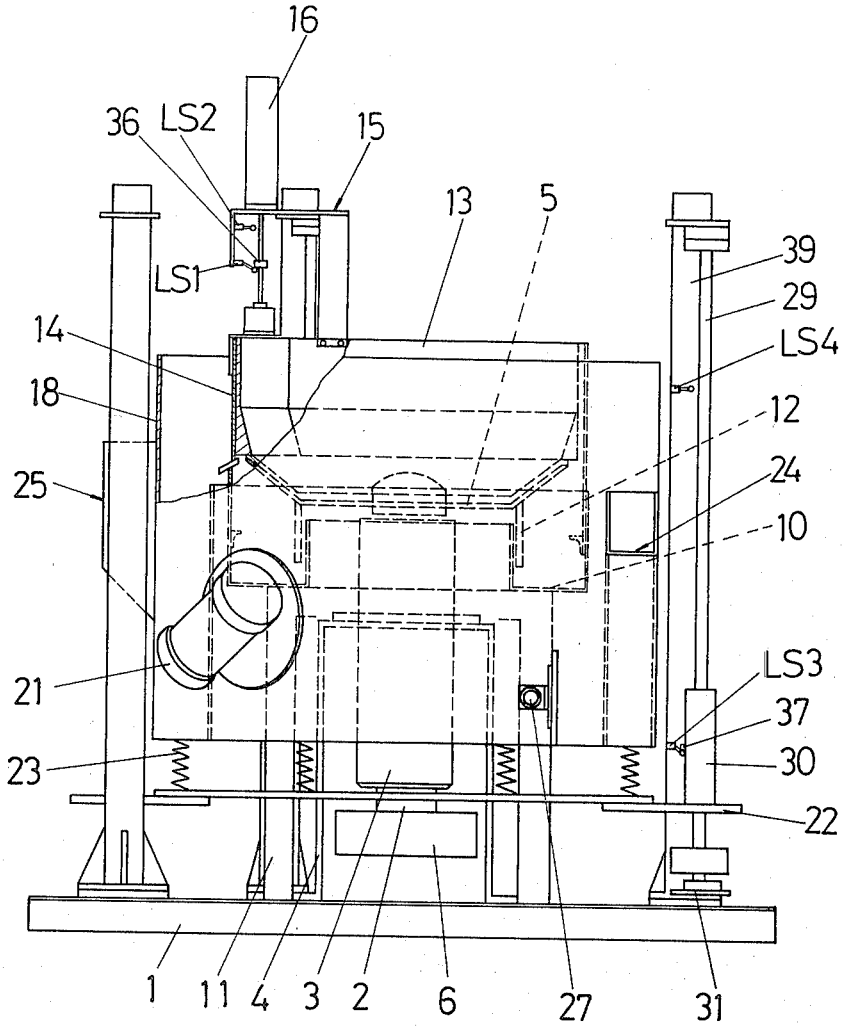
FIG. 1 is a front elevation, partly broken away, of the surface finishing machine according to one preferred embodiment of the present invention.
Figure 2:
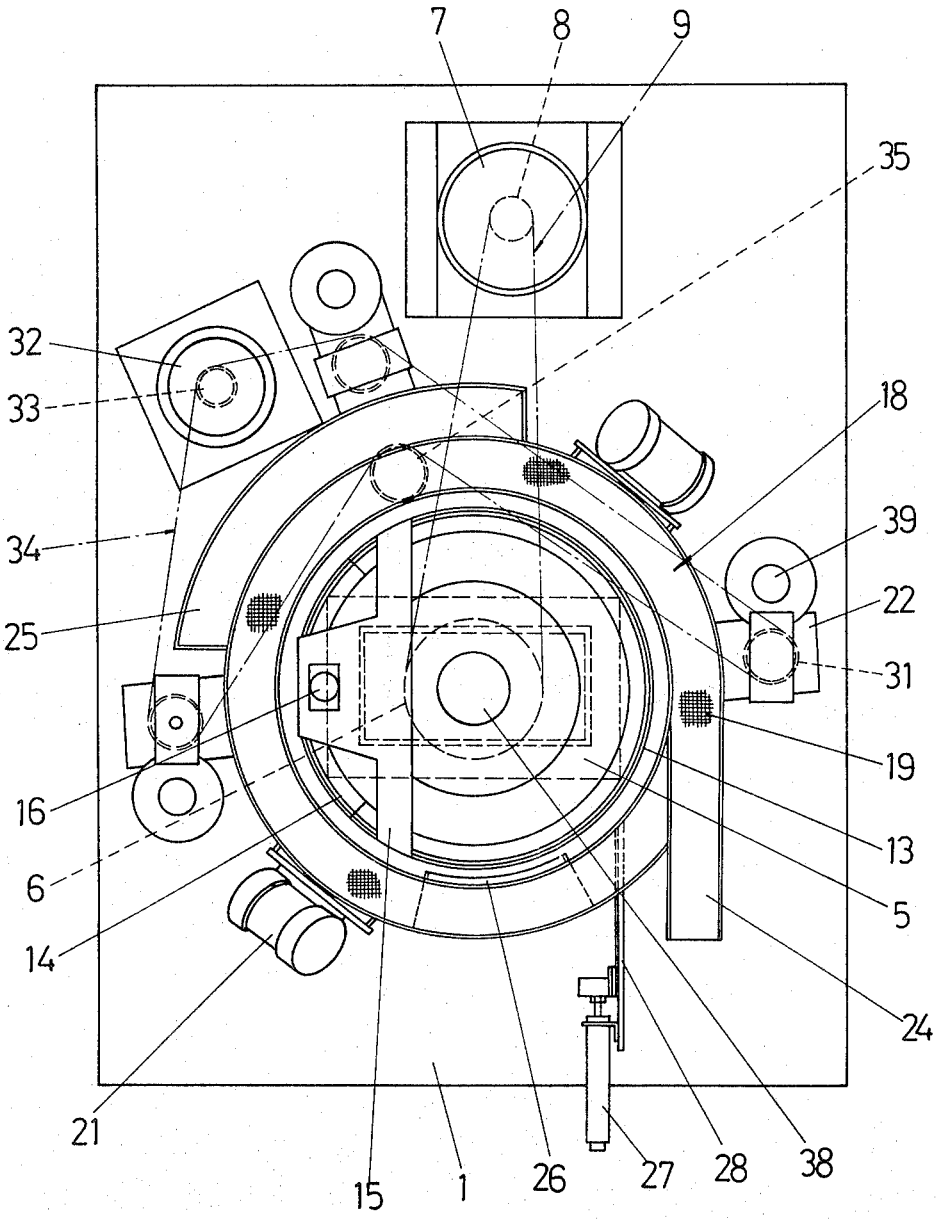
FIG. 2 is a plan view of FIG. 1.
Figure 3:
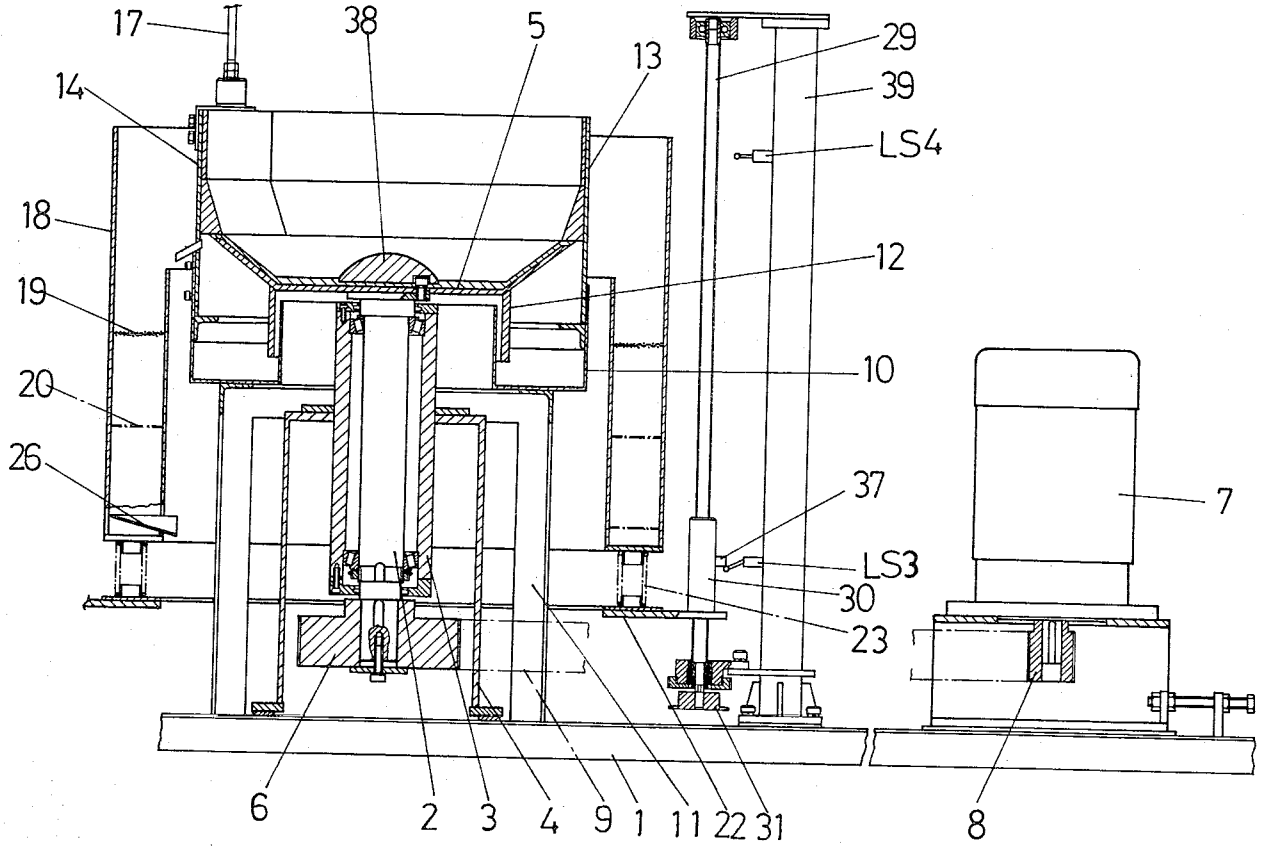
FIG. 3 is a longitudinal section front view of the machine in FIG. 1.

In this preferred embodiment of the present invention, the construction of the barrel finishing machine is illustrated in detail in FIGS. 1 to 3. In FIG. 1, the machine body is supported and mounted on a pedestal 1 which serves as a base for installing the machine body on the installation site floor. On the pedestal 1 is provided a bearing support 4 which extends vertically above the pedestal 1. A bearing 3 is secured to the bearing support 4, through which a vertical rotary shaft 2 is rotatably journalled. A tray-like rotary container 5 is secured to the upper end of the rotary shaft 2 in such a manner that the rotary container 5 can rotate with the rotary shaft 2. The lower end of the rotary shaft 2 carries a pulley 6 which connects with a pulley 8 on a variable-speed motor 7 mounted on the pedestal 1 (FIG. 2). The variable-speed motor 7 supplies a rotation to the pulley 6 on the rotary shaft 2 by way of a power transmission belt 9 connecting between the two pulleys 6 and 8. A combination of a general purpose motor and a frequency converter or inverter may be employed as an alternative to the above-mentioned variable-speed motor. A framed support 11 extends vertically from the pedestal 1, and supports an annular leak collector conduit 10 which is located below the rotary container 5 and serves as a passage for receiving a compound solution media which leaks from the barrel structure. The rotary container 5 has a cylindrical member 12 extending downwardly from the underside bottom of the rotary container 5 into the annular leak collector conduit 10. A cylindrical-shape stationary or non-rotational container 13 is provided above the rotary container 5, and is supported by the annular leak collector conduit 10 such that the stationary container in its lower position is capable of making contact with the outer extended circumferential edge of the leak collector conduit 10. More particularly, the stationary container 13 has a gate member 14 on one side thereof which is rigidly connected to a piston rod 17 of a fluid operated cylinder block 16 secured to an upper machine frame 15. Thus, the stationary container 13 is held in suspension by the cylinder piston rod such that part of the stationary container is capable of up and down movement under control of the cylinder. As a varied form of the embodiment shown, the stationary container may wholly be held in suspension by the upper frame and move up and down by the cylinder. As noted from the above description, the stationary and rotary containers 13 and 5 together constitute a workpiece surface finishing barrel in which a mass or a mixture of workpieces and abrasive media is to be contained. The barrel structure including the two containers is surrounded by an annular mass receptacle trough 18 the inner peripheral wall of which is located adjacent to the outer periphery of the barrel structure and which is capable of up-and-down-movement. The annular mass receptacle trough 18 has a mass separating screen 19 extending inside around almost the entire length of the annular trough 18, and an annular guiding conduit 20 below the screen 19 which receives an abrasive media falling down through the screen 19 and guides it. In the embodiment shown, the annular guiding conduit 20 provides a down-sloped two-stage spiral passage. This construction prevents the abrasive media falling down through the screen 19 from being accumulated on the grinding passage and thus overflowing back through the screen 19. However, a one-stage guiding passage may be employed, provided it is made deeper. A plurality of vibratory motors 21 are provided around the annular mass receptacle trough 18. The location of the vibratory motors 21 may be located around the bottom or side wall of the annular mass receptacle trough 18, and their number can be selected as appropriate depending upon the particular application requirements (two motors are shown in the embodiment). The motors 21 are mounted at predetermined inclinatory angles. A plurality of springs 23 are interposed between a horizontal spring support member 22 and the annular mass receptacle trough structure 18, so that the trough structure 18 can be oscillatably supported by the springs 23 under the vibrations generated by the vibratory motors 21. The annular mass receptacle trough 18 carrying the mass separating screen 19 has a straight-line workpiece outlet or discharge passage 24 extending from the end of the annular trough 18. A workpiece container 25 which contains a lot of workpieces next to be processed has an internal open side from which workpieces are to be charged into the annular guiding conduit 20. At the end of the annular guiding conduit 20 is provided a recharge Port 26 from which the abrasive media received through the mass separating screen 19 above, including a next workpiece lot (if any) is to be recharged into the finishing barrel structure. A stopper 28 is provided immediately before the recharge port 26, and is operated by a fluid-operated cylinder 27 for closing and opening the passage toward the recharge port 26. A plurality of vertical support posts 39 stand on the pedestal 1 and outside the annular mass receptacle trough 18, and each of the support posts 39 carries an externally threaded rod 29 for rotation. The upper end of each of the threaded rods 29 is rotatably connected to the upper side of the support post 39, and the lower side is inserted through a housing 30 secured to the spring support member 22. The housing 30 has a bearing inside for supporting the rod 29. The lower end of the rod 29 extending through the member 22 carries a sprocket 31 which engages a chain 34 which also engages a sprocket 33 on a gear motor 32. Reference numeral 35 in FIG. 2 denotes a chain tensioning means for the chain 34. As such, when the gear motor 32 is driven for rotation, its rotation is transmitted by means of the chain link 34 to each sprocket 31, which then drives the respective rod 29 for rotation. The rotation of the rod 29 causes the corresponding housing to be moved up or down along the rod according to the direction of the rotation of the rod, thus permitting the annular mass receptacle trough 18 to be vertically moved accordingly. The vertical movement of the annular mass receptacle trough 18 done in the above-described manner may be achieved by an alternative means such as a fluid-operated cylinder. The piston rod 17 for the cylinder 16 has a dog 36 which contacts either of limit switches $LS_1$ and $LS_2$ secured to the upper frame 15 supporting the cylinder 16. Similarly, the housing 30 has a dog 37 which contacts either of limit switches $LS_3$ and $LS_4$ secured to the support post 39. Both dogs 36 and 37 cooperate with the respective limit switch pairs so that when the dog 36 or 37 contacts either of the limit switches, in the respective pair, it opens the motor circuit. A conically-shaped member 38 is provided on the central bottom of the lower rotary container, and controls the flow of the mass inside the barrel. It is observed that the centrifugal force given by the rotating container 5 is weaker at the center, thus causing the part of the mass at the center to stay there during the rotation. The provision of the central conical member 38 has the effect of preventing the mass from being stagnant at the center and thus allowing the mass to have a uniformly toroidal flow under the action of the centrifugal force.

The construction of the surface finishing machine has been fully described in connection with the first preferred embodiment shown in FIGS. 1 to 3. For aiding in better understanding the functional advantages of the described construction, the sequences of the operation of the machine are now explained.

For the convenience of the easy understanding, the following description is based on the assumption that the machine is ready to start up, that is, the annular mass receptacle trough 18 is placed in its lower position with the gate member 14 of the stationary container 13 closed and the barrel structure including the stationary and rotary containers 13 and 5 has now contained workpieces to be processed and abrasive media which may include water, compound solution, etc. if required. As the machine has thus been set up for the operation, the variable-speed motor 7 is energized to supply its rotation, which causes the rotary container 5 to rotate by way of the intermediate chain link 9. The rotation of the rotary container 5 produces a centrifugal force in the container 5, causing the mass to be dispelled outwardly inside the rotary container 5 and to be pushed upwardly along the peripheral wall of the rotary container to travel along the same up to the stationary container 13. Then, the mass is falling down by its own weight or under the action of the gravity toward the center bottom of the rotary container 5 below the stationary container 13. In this manner, the mass is following the toroidal motion produced by the action of the centrifugal force. During the continued toroidal flow of the mass, the workpieces are subjected to the surface-finishing process provided by the rubbing action between the workpieces and abrasive media. Usually, the rotary container 5 is driven for rotation at the peripheral speed of 90 m/min. to 130 m/min., preferably in the range of 100 m/min. to 120 m/min. In the finishing process under wet condition, there occur leaks of water, compound, worn out abrasive particles, etc. in the sliding interface between the outer rim of the rotary container 5 and the lower peripheral edge of the stationary container 13. The most part of those leaks is introduced down into the annular leak collector conduit 10 located below the rotary container 5, and a small part of them is exiting from the outer periphery of the rotary container 5 to travel along its outer wall side toward the bottom and then enter the center of the bottom. As the down-directed cylindrical portion 12 extends from the underside of the rotary container 5, this part of the leak is dispelled outwardly and collected into the annular leak collector conduit 10. As noted from the above, all the leaks from the dual barrel container can thus be collected into the annular leak collector conduit 10. If the compound solution thus collected is still good for reuse, it can be returned to a separate media container for a repeated use.

For the rough finishing process under wet condition using the compound solution, however, the compound solution which is collected at the end of one cycle of the rough finishing operation often cannot be reused for the next succeeding cycle of the operation because it more easily becomes worse in its nature. In this case, the compound solution as collected at the end of each cycle of the operation is all disposed of for once. By supplying a fresh compound solution for each cycle of the operation it is thus possible to obtain the satisfactory finishing effect as expected.

At the end of one cycle of any type of the finishing operation, the timer which is previously set to be activated is then operated for switching the variable speed motor 7 to the low speed, causing the rotary container to rotate at the lower speed of about 50 m/min. and also causing the vibratory motors 21 for the annular mass receptacle trough 18 to be started. The start of the motors 21 causes the annular mass receptacle trough 18 to vibrate so that it can be placed in a ready state for receiving and separating the mass from the barrel structure. Subsequently, a pressurized fluid is introduced into the fluid operated cylinder 16 to permit its piston rod 17 to be withdrawn, thus causing the gate member 14 connected to the piston rod to be raised. During the course of the piston rod travel, the dog 36 of the piston rod contacts the upper limit switch $LS_2$, which is then activated for stopping the supply of the pressurized fluid into the cylinder. The movement of the gate member 14 is also stopped. As the rotary container 5 is rotating slowly during the upward movement of the gate member 14, the mass in the barrel structure is gradually discharged onto the separating screen 19 in the annular mass receptacle trough 18. During the transport of the mass on the vibrating annular mass receptacle trough 18, the mass is separated into processed workpieces which remain on the screen 19 and are travelling toward the discharge port 24, and abrasive media which is passed through the screen 19 and is folling down into the annular guide conduit 20 below the screen 19. The abrasive media is transported on the vibrating guide conduit 20 toward the stopper 28 which is now placed in its closed position. During the current cycle of the separating operation as described above, a succeeding lot of workpieces next to be processed which is previously contained in the container 25 open toward the guide conduit 20 is supplied from its open side into the guide conduit 20 and is transported together with the separated abrasive media toward the stopper 28. After the discharge of the mass from the rotary container 5 is nearly completed, the variable-speed motor 7 is again switched to the high speed, allowing the rotary container to rotate at high speed range of between 90 m/min. and 130 m/min. During the high speed rotation of the rotary container, the part of the mass remaining in the rotary container can be completely discharged from the container. After all processed workpieces have been collected from the discharge port at the end of the one operation cycle (the time period required for discharging all the workpieces from the machine is previously set by the timer to one to two minutes), the variable-speed motor 7 is automatically stopped. Then, the fluid operated cylinder 16 is operated to cause the gate member 14 to travel down toward its original lower position, and the gear motor 32 is also energized to permit the annular mass receptacle trough 18 to be moved up. During the above sequence of the operation, the vibratory motors 21 may be stopped or may continue to be in operation. Keeping the motors 21 in operation is more effective, however, since with the motors in the operative state it is possible to proceed with the next succeeding cycle of the operation without any time loss. In the embodiment shown, therefore, it is chosen that the vibratory motors 21 are kept in operation during the time interval from one cycle of the operation to another. The annular mass receptacle trough 18 is being moved up until the dog 37 on the housing 30 finally reaches the limit switch $LS_4$. As the dog 37 contacts the switch $LS_4$, the switch $LS_4$ is operated to deenergize the gear motor 32, thus bringing the annular mass receptacle trough 18 to rest. When the switch $LS_1$ is contacted by the dog 36 and the switch $LS_4$ is contacted by the dog 37, a pressurized fluid is introduced into the piston rod side of the fluid operated cylinder 27. As the piston rod is retracted into the cylinder, it allows the stopper 28 to be moved therewith, opening the passage for the abrasive media and a new lot of workpieces to allow them to be charged into the finishing container through the charging port 26. At the same time, the rotary container 5 is driven for rotation at a low peripheral speed of about 50 m/min. During this rotation, the new mass is charged into the barrel structure in a uniformly distributed manner.

Upon completion of the mass charging operation, the timer automatically stops the vibratory motors 21 and causes the gear motor 32 to rotate in a reverse direction as opposed to the direction which allows the annular mass receptacle trough 18 to travel up. The reverse rotation of the gear motor 32 causes the annular mass receptacle trough 18 to be lowered from its raised position. The cylinder 27 is also operated so that this time it causes the stopper 28 to close the passage. As the annular mass receptacle trough 18 is being lowered and when finally the dog 37 on the housing 30 contacts the limit switch $LS_3$, the mass receptacle trough is stopped its lowering and then it is activated to permit the variable-speed motor 7 to rotate at high speeds. During the high speed rotation of the rotary container driven by the motor 7, the workpieces in the container receive the finishing process as earlier described. All the operation sequence subsequent to the finishing operation is performed in the manner described above. For replacing the used abrasive media with a new abrasive media, the annular mass receptacle trough 18 is first moved down to its lowest position, and the used abrasive media is discharged from the recharge port 26 of the guide conduit 20. A new abrasive media, which is previously contained in the workpiece container 25, is then placed into the guide conduit 20 as for the new workpiece lot. The subsequent operation is the same as for the feeding of the new workpiece lot together with the abrasive media to be returned for re-use.

Figure 5:
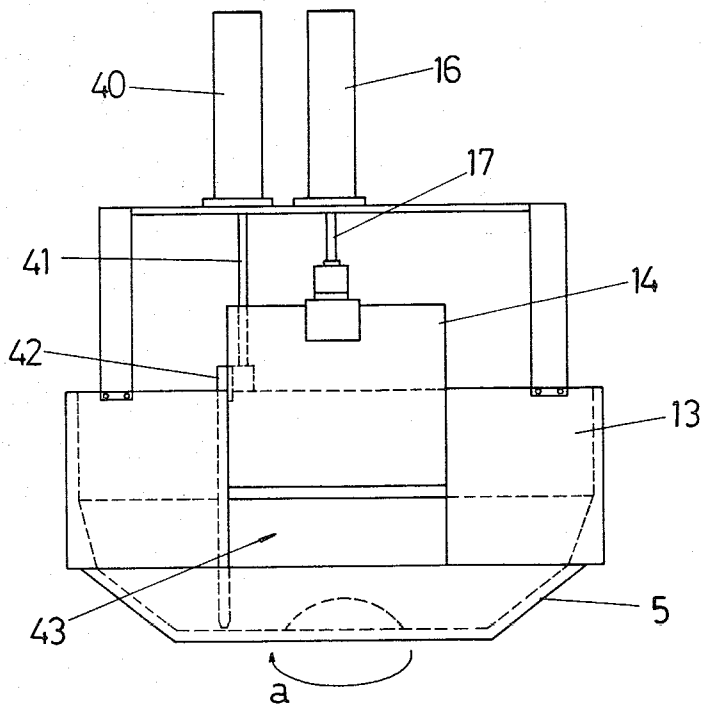
FIG. 5 is a front elevation of FIG. 4.
Figure 4:
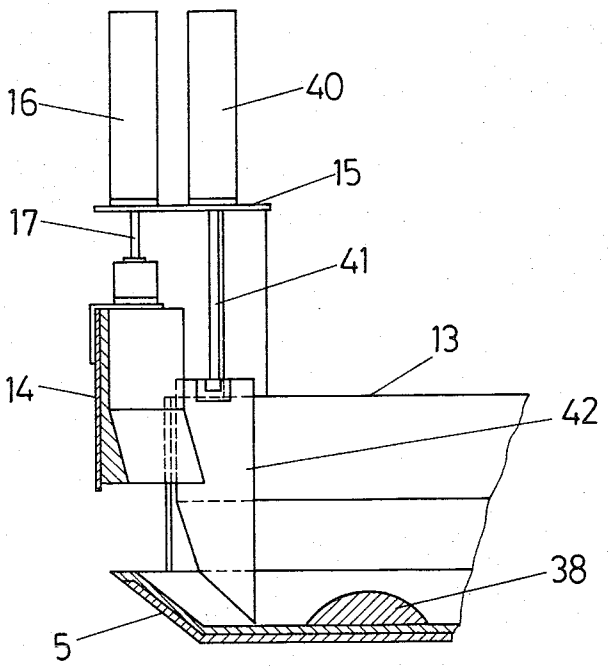
FIG. 4 is a sectional view of a varied form of the preferred embodiment shown in FIGS. 1 to 3.

FIGS. 4 and 5 show a variation of the above-described embodiment. In this varied form, a fluid operated cylinder 40 is rigidly fixed to the upper frame 15, and its piston rod 41 carries a blocking plate 42 secured to the end thereof and held in suspension therefrom. If the rotary container 5 is driven for rotation in the direction indicated by an arrow a in FIG. 5, the blocking plate 42 is placed in sliding contact with the gate member 14 and stationary container 13 and on the left side in FIG. 5. The blocking plate 42 is used at the time of discharging the mass from the finishing barrel structure. The other operations except for the operation of the blocking plate 42 in this particular form are the same as those in the earlier basic embodiment. The following description is therefore limited to the operation of the blocking plate 42 to be performed at the time of the mass discharge. At the end of one cycle of the finishing operation, the rotary container 5 is switched to the low speed rotation and the vibratory motors 21 for the annular mass receptacle trough 18 are started to place the annular mass receptacle trough 18 under vibration. The annular mass receptacle trough 18 is thus ready to separate the mass. Then, the fluid operated cylinder 16 is operated to cause the gate member 14 to travel up, while the fluid operated cylinder 40 is operated by introducing a pressurized fluid into the piston side, permitting the blocking plate 42 to travel down. The mass travelling in the direction indicated by the arrow a in FIG. 5 is blocked by the blocking plate 42, and is thus discharged through the opening 43. The blocking plate 42 is useful in reducing the time required for discharging the mass from the barrel structure.

Figure 6:
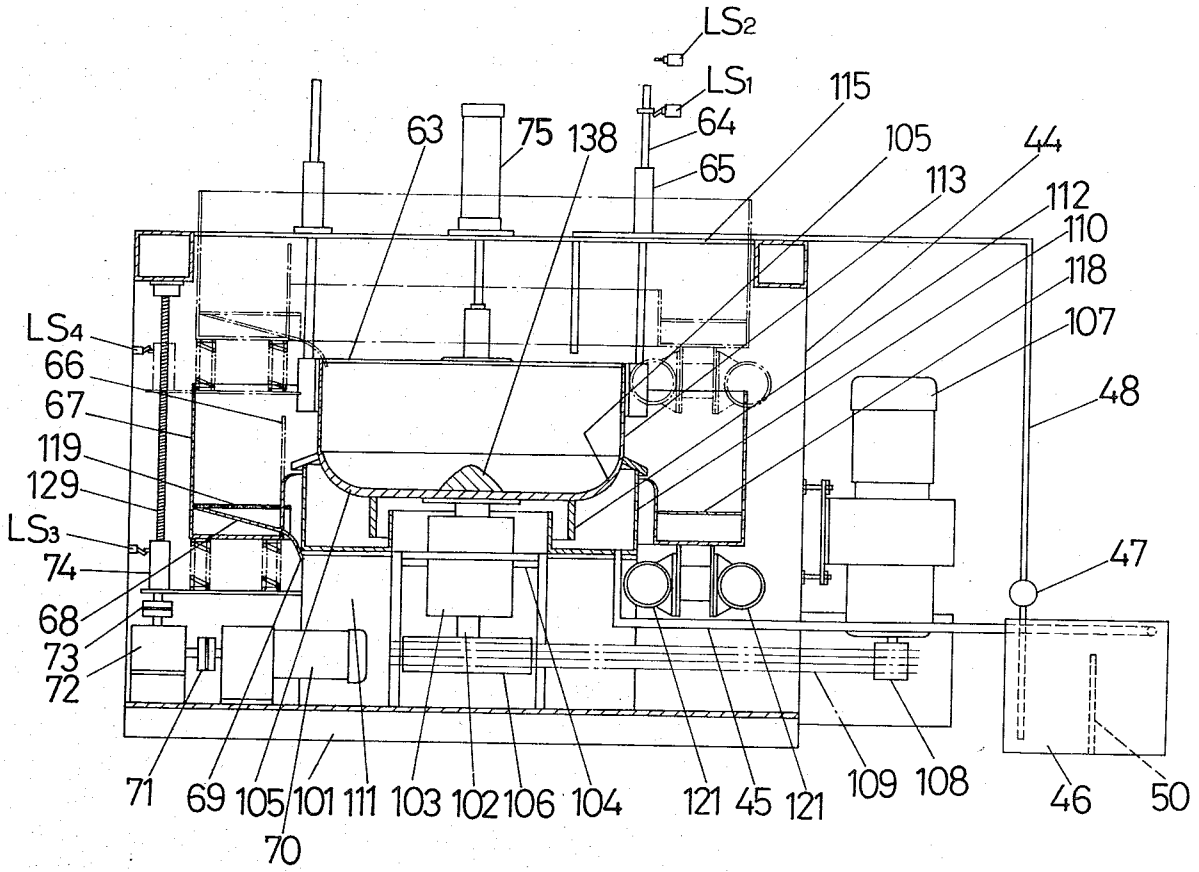
FIG. 6 is a longitudinal section front view of another preferred embodiment of the present invention.
Figure 7:
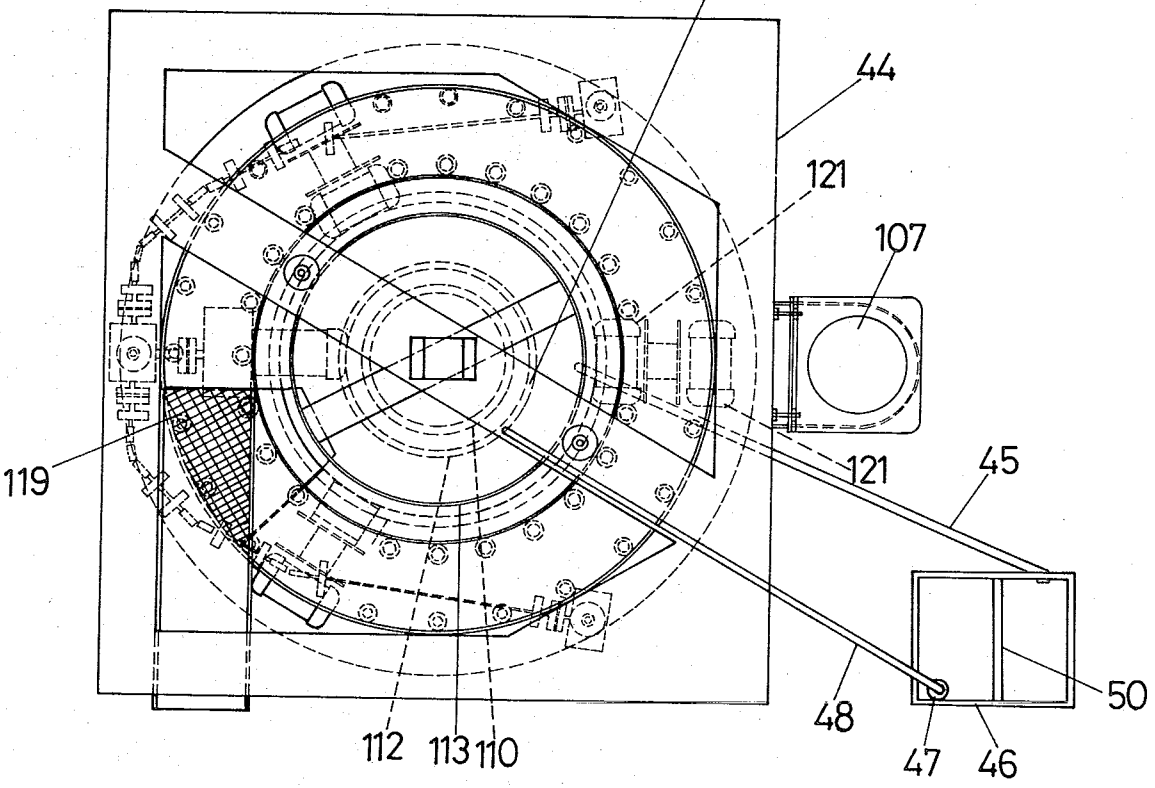
FIG. 7 is a plan view of FIG. 6.

The construction of another preferred embodiment is shown in FIGS. 6 and 7. Generally, the construction shown in FIGS. 6 and 7 is similar to that shown in FIGS. 1 to 3 except for the specific features of the embodiment in FIGS. 6 and 7. For the convenience of the simplicity of the description, the arrangement of those operative parts or elements which are similar to those in the earlier embodiment is not described, and the following description will be directed to the parts or elements specific to the embodiment of FIGS. 6 and 7. For reference purpose, those similar parts or elements are given corresponding numerals in FIGS. 1 to 3 but increased by one hundred, while the specific parts of elements are given two-digit numerals.

In the construction shown in FIG. 6, the upper stationary container 113 is held in suspension movably up and down by means of a fluid-operated cylinder 62 secured to the upper frame 115. More specifically, an upper frame 63 secured to the top of the upper stationery container 113 is connected to a piston rod of the fluid-operated cylinder 62, and a rod member 64 is secured at one end thereof to the lateral side of the stationary container 113 and is moved up and down slidably through a housing 65 secured to the upper frame 115. A plate 66 is provided for preventing a mass being discharged from the dual barrel structure from entry into the mass separating device 119. A member 67 in the form of a bellows extends from the annular mass receptacle trough 118, and is adapted to retract when it is brought into contact with the upper frame 115. A rubber guide 69 is provided at the leading end of the media guide conduit 68, and serves a bridge to introduce the media from the conduit 68 into the barrel structure 113. Outside the media guide conduit 68 are provided externally threaded rod members which are capable of rotation on their axes. The rotation of the rod member 129 is accomplished by the links including a gear motor 70, a coupler 71, a gear box 72, and a coupler 73. The other rod members are also rotated by the similar links not shown. Reference numeral 74 denotes a housing which accommodates the rod member 129 and is capable of engaging with the member 129. The rotation of the member 129 permits the housing 74 to be raised or lowered. Numeral 74 denotes a universal joint included in the above linkage.

The embodiment shown in FIGS. 6 and 7 includes an additional recirculating means for leaks of the liquid abrasive media, which collects the leaks into a collector tank and recycles them back into the finishing barrel structure. The dual-barrel structure is provided at the center and is enclosed by a machine frame 44 together with other associated parts or elements. The dual barrel structure consists of an upper stationary container 113 and a lower rotary container 105. The upper stationary container 113 is capable of movement up and down relative to the lower rotary container 105. On the other hand, the rotary container may be capable of movement up and down relative to the stationary container 105. In operation, the upper stationary container 113 is placed in its lower position in which it has a sliding contact with the upper peripheral edge of the lower rotary container. The lower rotary container 105 includes a cylindrical member 112 extending downwardly from the underside bottom of the container 105, and an annular leak collector conduit 110 for collecting leaks of compound solution in provided below the rotary container 105 and accommodates the cylindrical member 112. The annular leak collector conduit 110 is supported by a support frame 111 extending from a machine pedestal 101. One end of an outlet pipe 45 is connected to the bottom of the annular leak collector conduit 110, extending toward a leak collector tank 46 and being connected at the other end to the tank 46. One end of a delivery pipe 48 is connected through a circulating pump 47 to the tank 46, and the other end of the delivery pipe 48 is led toward the top of the stationary container 113. For applications where there is no need of recirculating the collected compound solution, the recirculating means that includes the tank, pump and delivery pipe may be omitted or bypassed so that the other end of the collector pipe is led to an external disposal port (not shown). As in the earlier embodiment shown in FIG. 1, a conical shape member 138 is provided at the central bottom of the rotary container 105, and provideds the same function of promoting the toroidal flow of the mass inside the rotary container 105. As already described, the action of the centrifugal force produced by the rotary container which is driven for rotation is weaker about the center of the rotary container, thus causing the mass to be stagnant there without the aid of the central conical shape member 138. The provision of this conical shape member 138 serves to expel the most part of the mass toward the peripheral wall of the rotary container 105 and permit it to travel upwardly toward the upper stationary container along the peripheral walls of the two containers. This produces a toroidal motion in the mass, allowing the mass to have the smooth and uniformly toroidal flow. In the embodiment shown, the conical shape member is provided, but other similar shapes may be employed.

The operation of the above described construction is now described in connection with FIGS. 6 and 7. It should be understood that the surface finishing operation and other associated operations are performed similarly to those in the earlier embodiment, except for the operation associated with the features specific to the current embodiment. Before starting up the machine, it is also assumed that the dual-barrel structure has already contained a lot of a mass, that is a mixture of quantity of workpieces to be surface finished and a quantity of solid abrasive media. The current embodiment in FIGS. 6 and 7 is specifically designed for the wet-type surface finishing process under wet condition which involves the supply of water, compound solution, etc. Therefore, the finishing containers also contain a compound solution continuously to be supplied from the tank 46 by way of the pump 47 and delivery pipe 48. For operation, the variable-speed motor 107 is first energized, causing the rotary container 105 to rotate by way of the power transmission links such as motor pulley 108, intermediate chain or belt 109, pulley 106 and rotary shaft 102. The high-speed rotation of the rotary container produces a centrifugal force therein which expels the mass outwardly toward the peripheral wall of the rotary container 105 and pushes it upwardly along the wall of the container 105 toward the upper stationary container 113. The part of the mass which is being pushed up under the action of the centrifugal force flows toward the central space of the container 105 which is less influenced by the centrifugal force action, and is thus allowed to fall down toward the central bottom of the rotary container by its own gravity. That part of the mass over the central conical member 138 is again expelled outwardly by the member 138. During the rotation of the rotary container, the above motion of all the mass is repeated, thus allowing it to travel following the trace of a toroidal flow defined by the action of the centrifugal force. During the toroidal flow of the mass, the workpieces are surface finished by its interaction with the abrasive media. During the operation or at rest, leaks of compound solution, etc. occur in the sliding contact or interface between the upper peripheral edge of the rotary container 105 and the bottom peripheral edge of the upper stationary container 113. The most part of those leaks are introduced down into the annular leak collector conduit 110 located below the rotary container 105, but some part is travelling along the outer side wall of the rotary container 105 and attempts to enter into the bearing box 103. However, this part of the leak is dispelled by the cylindrical member 112 before entering the bearing box 103, and is then completely introduced into the conduit 110. All the leak thus collected in the conduit 110 is returned through the outlet pipe 45 to the collector tank 46. The tank 46 has a partition 50 inside, which separates the tank 46 into two chambers. The compound solution being collected in the first chamber is finally flowing beyond the partition 50 into the second chamber. The portion of the solution in the second chamber is suctioned by the pump 47 to be fed again into the finishing container structure by way of the delivery pipe 48. This recirculation of the collected compound solution is repeated during the surface finishing operation. At the end of one cycle of the finishing operation, the variable-speed motor 107 is automatically deenergized, bringing the rotary container 105 to a rest, while the pump 47 is automatically stopped so that the supply of the compound solution is stopped. The surface-finished workpieces together with the used abrasive media are automatically discharged from the barrel structure through its discharge port (not shown).

The mass that has thus been discharged is then separated into the workpieces and abrasive media by means of the appropriate mass separating device such as that fully described in the earlier embodiment. It is also possible manually to pick out individual workpieces from the barrel container structure while the abrasive media remains therein.

Figure 8:
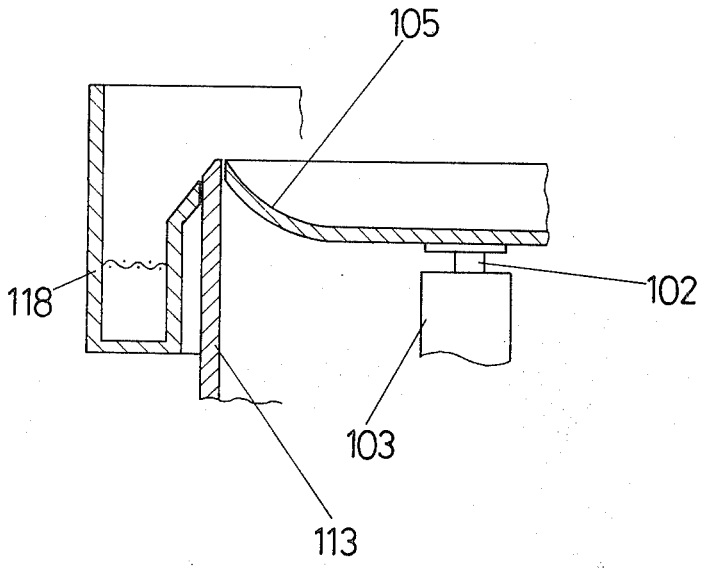
FIG. 8 is a partly enlarged sectional view of a varied form of the embodiment shown in FIG. 6.

In a varied form shown in FIG. 8, the discharging of the mass is performed by moving up and down either of the upper stationary container 113 and the lower rotary container 105. For the finishing operation, the stationary container 113 is raised to be brought in sliding contact with the rotary container 105, or the rotary container is lowered to be brought in sliding contact with the upper stationally container 113. After the finishing operation, either that the stationally container 113 is lowered or the rotary container 105 is raised so that the mass in the containers can be discharged onto the annular mass receptacle trough 118.

Figure 9:
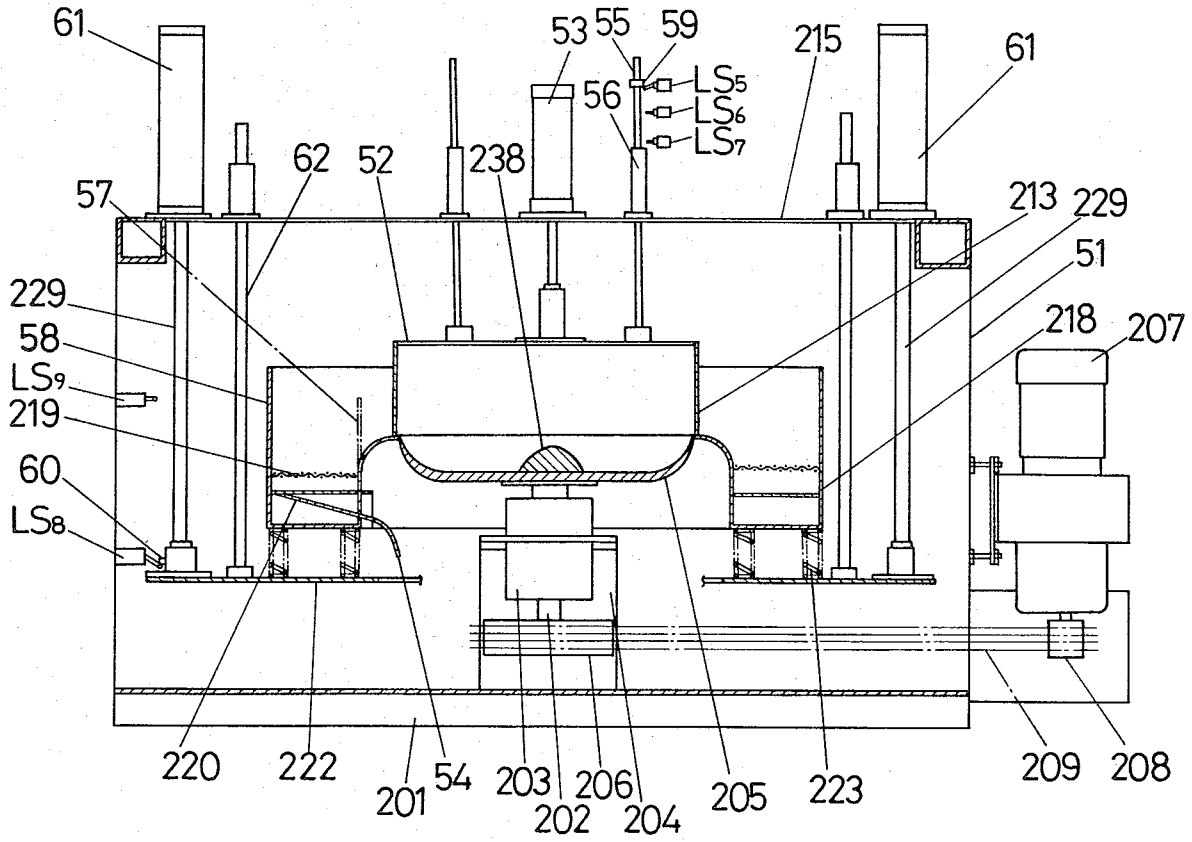
FIG. 9 is a longitudinal section front view of another preferred embodiment of the present invention.

A third preferred embodiment shown in FIG. 9 has the construction which is generally similar to those in the two earlier embodiments. The parts or elements which are common to those in the first embodiment are given corresponding reference numerals but increased by two hundreds. Those parts or elements are operated similarly to those in the earlier embodiments, and therefor the description of them is omitted for avoiding the duplication of the description. The feature which is specific to the current embodiment is described by referring to FIG. 9. In FIG. 9, an annular mass receptacle trough 218 is provided to surround close to the central dual-barrel structure consisting of an upper stationary container 213 and a lower rotary container 205. The mass receptacle trough structure 218 provides the same function as described in the earlier embodiments, and is supported on a support plate 222 such that the trough 218 is capable of movement up and down. In detail, the trough 218 is supported on the support plate 222 by way of springs 223. The support plate 222 is held in suspension from the above by means of a rod member 62 which is slidably supported by the upper frame 215. A rod member 229 is secured at one end thereof to the support plate 222, and is connected at the opposite end thereof to a fluid-operated cylinder 61 mounted on the upper frame 215. The fluid operated cylinder 61 is operated to expand or retract its rod member 229, thereby permitting the support plate 222 to be moved down or up. The limit of the movement up and down of the mass receptacle trough 218 is controlled by the cooperating action of a dog fixed to the lower end of the rod member 229 and the upper and lower limit switches $LS_9$ and $LS_8$. The rod member 229 may be replaced by a chain or rope which is driven by any suitable gears or slide block.

The surface finishing machine which has been described in conjunction with the various preferred embodiments of the present invention can be used for the surface finishing process and other processes that include deburring, radiusing, polishing, milling, mixing, agitating, and the like. It should be understood, therefore, that the constructional and operational features which enable the machine to be used for the above-mentioned applications fall within the scope of the present invention.

The features and advantages of the present invention provided by the above-described various preferred embodiments may be summarized as follows. The annular mass receptacle trough surrounding the dual barrel structure is provided for receiving the mass from the barrel structure, and is capable of movement up and down. This arrangement of the mass receptacle trough can effectively reduce the floor space required for installing the machine. The fully automatic functions provided by the machine can effectively reduce the time required for the associated operations other than the workpiece finishing operation. In effect, those associated operations can be performed in a total period of time of two to three minutes remarkably less than that achieved by the prior art, i.e., ten or more minutes.

For the wet-type finishing operation under wet condition using the compound solution, the combination of the annular leak collector and the means for preventing the leak entering into the bearing box advantageously eliminates the dual structure for the lower rotary container provided by the prior art for the same purpose. The central conical shape member provided in the rotary container provides the function of promoting the toroidal flow of the mass without producing no flow area about the center of the rotary container.

The annular mass receptacle trough in its preferred form which in operation is always placed under the vibration supplied by the vibratory motors below provides the smooth and stable mass separating function which permits the mass to be separated into workpieces and abrasive media. This is accomplished by gradually discharging the mass from the barrel structure onto the mass receptacle trough. Thus, there will not occur damages on the workpieces due to the piece-on-piece impingement during the mass separating operation.

Although the present invention has been described by reference to the various embodiments and varied forms thereof, it should be understood that various changes and modifications may be made without departing from the spirit and scope of the invention.

What is claimed is:

1. A workpiece finishing machine for the surface finishing, radiusing, gloss polishing, deburring, milling and the like, which comprises:

a dual-barrel structure for containing a mass of a lot of workpieces to be processed and an abrasive media and consisting of an upper stationary container and a lower rotary container either of which is movable away from the other; and an annular mass receptacle trough structure surrounding close to said dual-barrel structure and including means for causing said mass receptacle trough structure to be moved up and down, vibration generating means for causing said mass receptacle trough to be vibrated, means for separating the mass into workpieces and abrasive media, and means for returning the abrasive media for reuse.

2. A workpiece finishing machine as defined in claim 1, wherein said upper stationary container is capable of movement up and down with respect to said lower rotary container.

3. A workpiece finishing machine as defined in claim 2, wherein said upper stationary container is partly moved up and down.

4. A workpiece finishing machine as defined in claim 3, wherein a blocking member is provided movably up and down inside said dual barrel structure, for controlling the discharge of the mass from said dual barrel structure.

5. A workpiece finishing machine as defined in claim 1, wherein said lower rotary container is capable of movement up and down with respect to said upper stationary container.

6. A workpiece finishing machine as defined in claim 1, further including a means for controlling the flow of the mass including a substantially conical shape member provided at the central bottom of said lower rotary container.

7. A workpiece finishing machine as defined in claim 1, wherein said means for causing said mass receptacle trough to be raised or lowered includes a support member for supporting said mass receptacle trough thereon, an internally threaded housing secured to said support member, an externally threaded rod member engaging said internally threaded housing, and means for driving said externally threaded rod member for rotation and causing said support member to be raised or lowered.

8. A workpiece finishing machine as defined in claim 1, wherein said means for causing said mass receptacle trough to be raised or lowered includes a support member for supporting said mass receptacle trough thereon, means for supporting said support member in suspension from the above, and means for permitting said support member to be raised or lowered.

9. A workpiece finishing machine as defined in claim 1, wherein said means for returning the abrasive media for reuse includes a container for a next lot of workpieces to be processed and/or new abrasive media, said container being exposed toward said media returning path for allowing the workpieces and/or abrasive media to be fed onto said media returning path, and a fluid-operated stopper member for opening or closing said media returning path.

10. A workpiece finishing machine as defined in claim 1, wherein said means for separating the mass into workpieces and abrasive media includes a mass sieving screen extending inside arround almost the entire length of said mass separating means and an extension outlet path for the workpieces, and said abrasive media returning means includes a recharging port at the end thereof for allowing the workpieces to be processed and abrasive media to be introduced into said dual barrel structure.

11. A workpiece finishing machine as defined in claim 1, further including a rotary shaft bearing protecting means including an annular leak collector conduit provided below said lower rotary container for collecting leaks of the compound solution from the barrel structure, and a cylindrical member extending from the underside bottom of said lower rotary container into said annular leak collector conduit, said cylindrical member rotating with said lower rotary container so that part of the leaks can be expelled outwardly into said annular leak collector conduit, thereby protecting the rotary shaft bearing against entry of said part of the leaks.

12. A workpiece finishing machine as defined in claim 11, wherein said annular leak collector conduit includes a recirculating means for the collected compound solution.

13. A workpiece finishing machine as defined in claim 12, wherein said recirculating means includes an outlet pipe extending from the bottom of said annular leak collector conduit, a tank connected to said outlet pipe for containing the collected compound solution, a suction pump connected to said tank, a delivery pipe connected to said suction pipe for recharging the compound solution into said dual barrel structure.

* * * * *